United States Patent [19]

Taylor

[11] Patent Number: 4,787,348

[45] Date of Patent: Nov. 29, 1988

[54] CARBON-CLEANING APPARATUS FOR DIESEL ENGINES

[75] Inventor: Timothy A. Taylor, Santa Ana, Calif.

[73] Assignee: Parker Automotive Corporation, Santa Ana, Calif.

[21] Appl. No.: 148,339

[22] Filed: Jan. 25, 1988

[51] Int. Cl.[4] ..... B08B 3/08

[52] U.S. Cl. ..... 123/198 R; 123/198 R; 134/123; 134/169 A

[58] Field of Search ..... 123/198 A, 198 R; 134/123, 169 A

[56] References Cited

U.S. PATENT DOCUMENTS

| | | | |
|---|---|---|---|
| 2,201,774 | 5/1940 | Hufele | 123/198 A |
| 2,968,585 | 1/1961 | Giammaria | 123/198 A |
| 4,006,311 | 8/1986 | Reyes et al. | 123/198 A |
| 4,167,193 | 11/1979 | Magnus et al. | 134/169 A |
| 4,520,773 | 6/1985 | Koslow | 123/198 A |
| 4,659,123 | 11/1977 | Bartos et al. | 123/169 A |
| 4,671,320 | 6/1987 | Turnipseed | 123/198 A |

*Primary Examiner*—Raymond A. Nelli

*Attorney, Agent, or Firm*—Francis X. LoJacono

[57] ABSTRACT

A carbon-cleaning apparatus for diesel engines having an independent fuel-flow system including a diesel/-chemical mixture fuel tank adapted to be interconnected to a diesel engine at the engine's fuel injection, there being an electronic control and monitoring system to operate the fuel-flow system during the cleaning operation of the engine.

19 Claims, 3 Drawing Sheets

CARBON-CLEANING APPARATUS FOR DIESEL ENGINES

BACKGROUND OF THE INVENTION

This invention relates generally to an apparatus for cleaning the internal body of an engine, and more particularly to an apparatus and process for cleaning carbon and related residue and contaminants deposited within the internal body of a diesel engine and its component parts such as the injection pump, fuel injectors, fuel lines, etc., without the need to dismantle the engine and the associated parts thereof.

The industry is well aware of the various problems and difficulties encountered in providing suitable means for cleaning carbon deposits found on the surface areas within the combustion chamber of a diesel engine.

There are various methods that have been tried to solve this problem. One method employed is to provide chemical additives to dissolve soft carbon deposits on the combustion surfaces. These chemicals are applied in several ways, one being by simply adding selective chemicals to the fuel tank that supplies diesel fuel to the engine whereby the chemical is mixed and carried through the entire closed fuel system. Accordingly, in a closed fuel system of the type required in the operation of diesel engines, residue and other foreign material removed from the carbon-covered surfaces are not necessarily removed from the system. If not completely removed from the diesel-fuel system, such residual particles contaminate the system and eventually return to the fuel tank for deposit therein. Hence, these foreign particles are always present to clog and/or obstruct fuel flow at some later time.

A more positive but expensive means of removing carbon from a fuel diesel engine is to physically take the engine apart in order to clean the individual parts. This requires the costly and time-consuming dismantling of the engine, and often the fuel pump and injectors as well.

Therefore, there has been a search for a more complete and simple method or process for removing carbon build-up in the form of a simple, safe and less-costly cleaning operation which can be performed to provide for a total carbon-free diesel system while at the same time purging the complete system of all residual contaminants.

SUMMARY OF THE INVENTION

Accordingly, it is an important object of the present invention to provide a carbon-cleaning apparatus for diesel engines that solves all of the aforementioned problems.

Another object of the invention is to provide a carbon-cleaning device for diesel engines that includes an electrical control system together with an independent fuel-flow system defined by two fuel-flow sub-systems that temporarily replace the fuel-flow system of the specific diesel engine to be cleaned.

Still another object of the invention is to provide a carbon cleaning apparatus that includes a special chemical and diesel-fuel mixture stored within an independent fuel-flow system that removes and filters out contaminants in a diesel engine, its injection pump, fuel injectors, fuel lines, etc., whereby the chemical mixture is introduced into the engine's combustion chamber and continues the cleaning process by dissolving soft carbon deposits on the combustion surfaces thereof. This is done without manually removing and overhauling the engine and its associated parts.

A further object of the present invention is to provide a carbon-cleaning apparatus of this character that is completely portable and operates on a 12-volt DC electrical system which can be powered by the vehicle's battery or by a 115-volt AC current source.

A still further object of the present invention is to provide an apparatus of this character that is self-contained and includes a 72 GPH high-volume fuel pump, a two-micron fuel filter water separator, a water-contamination sensor, and a one-gallon mixture-supply tank.

It is a still a further object of the present invention to provide an apparatus of this character that has relatively few operating parts to accomplish a complete carbon purge of a diesel engine and its related parts.

Still another object of the present invention is to provide a device of this character that is easy to service and maintain and relatively simple to operate, thereby reducing drastically the overall cost of such an operation.

A further object of the invention is to provide a device of this type that is relatively inexpensive to manufacture, and is simple and rugged in construction.

The various features of novelty which characterize the invention are pointed out with particularity in the claims annexed to and forming a part of this disclosure. For a better understanding of the invention, its operating advantages by its use, reference should be had to the accompanying drawings and descriptive matter in which there is illustrated and described the preferred embodiment of the invention.

BRIEF DESCRIPTION OF THE DRAWINGS

Referring more particularly to the accompanying drawings, which are for illustrative purposes only.

DETAILED DESCRIPTION OF THE PREFERRED EMBODIMENT

Figure 1:
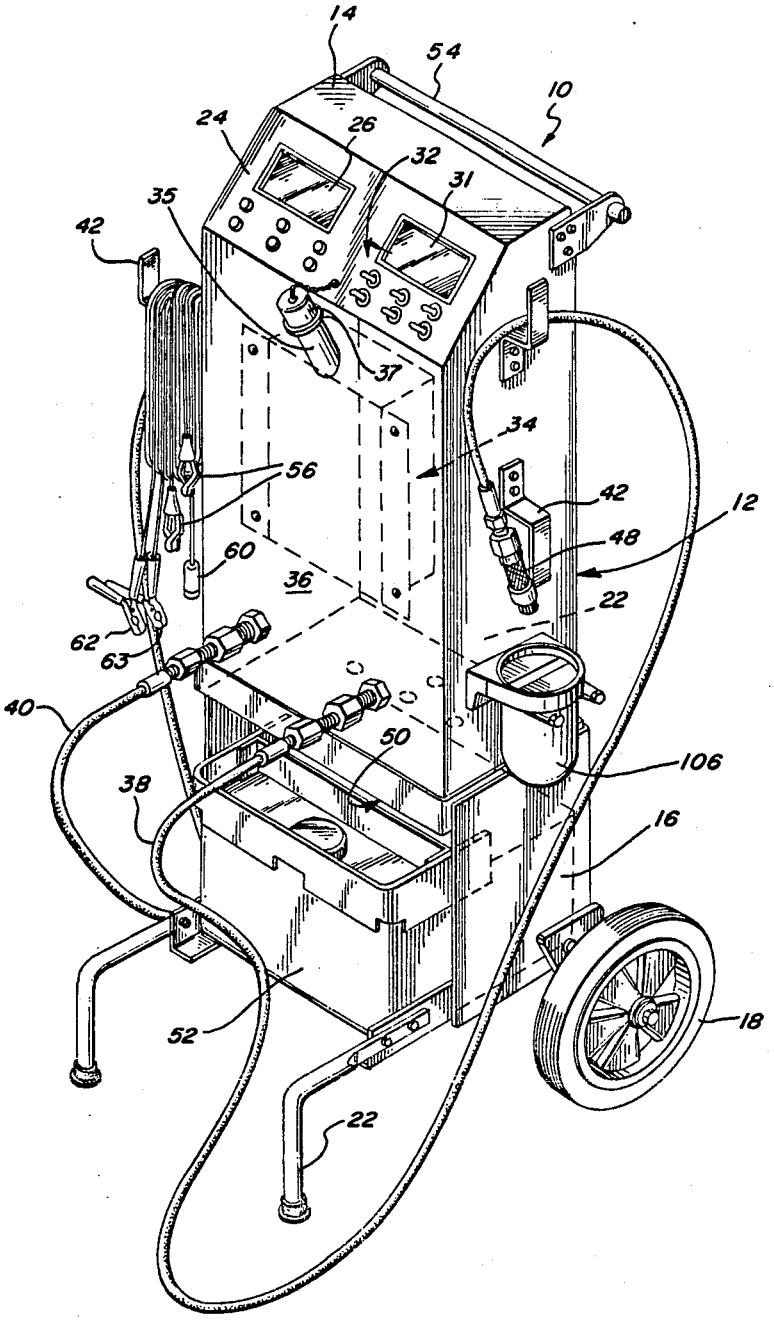
FIG. 1 is a pictorial view of the present invention.

Referring more particularly to FIG. 1, there is shown a self-contained carbon-cleaning apparatus, generally designated at 10, and defined by a housing, indicated at 12, having an upper housing section 14 and a lower or bottom section 16. The sections 14 and 16 are attached one above the other and supported by a carrier means comprising a pair of cart wheels 18 mounted to the lower rear area of the bottom housing section 16, support legs 20 being secured to the lower front portion of the lower section 16.

Upper housing section 14 is formed so as to define a component compartment 22 in which are mounted the various electronic components that cooperate with the self-contained fuel-mixture flow system. Several component parts are located in the upper face plate 24 and are illustrated to represent a system level gauge 26 and a tachometer 31. A group of manually operated switches 32 are positioned under a tachometer 31, the operation of which will be hereinafter discussed in more detail.

A one-gallon fuel-mixture supply tank, designated generally at 34, is mounted within compartment 22 in the midsection thereof, whereby a filler neck 35 is attached thereto and extends upwardly and outwardly from the front wall 36 so as to provide access to the mixture tank 34. Thus, a cleaning chemical is allowed to be inserted in tank 34. Preferably, tank 34 has a total storage capacity on one gallon of mixture.

A pair of hose lines are shown mounted to the front wall 36 just below mixture tank 35. Accordingly, line 38 defines a fuel-mixture output line and line 40 defines a fuel-mixture return line. When lines 38 and 40 are not in use, they are readily arranged to be supported and stored by means of hanger brackets 42 mounted to opposite side walls 44 and 46 of upper housing 14. Each line 38 and 40 is provided at one end thereof with a quick connect coupler, indicated at 48 and 49, respectively.

The bottom or lower housing section 16 is defined as an open compartment 50 in which is removably stored an auxiliary diesel-supply tank 52. This tank resupplies primary fuel to mixture tank 34 as hereinafter described. Thus, the self-contained apparatus is readily movable for direct hookup to a diesel engine (not shown) by means of wheels 18 and housing handle 54.

Operating Procedure

The diesel engine and its related parts are not shown herein since they are well understood in the art and are not directly part of the present invention.

When the carbon-cleaning device of the present invention is to be employed, one disconnects the engine's inlet and return fuel supply lines and then plugs these lines to prevent leakage of fuel from the vehicle's fuel tank, and also to prevent air from entering the disconnected fuel system. Output line 38 and return line 40 are then connected to the respective ports of the engine's fuel-injection pump (not shown) by means of adaptor connectors 48 and 49.

The operator disconnects one of the wires of the vehicle's wiring system that goes to the engine's fuel cut-off solenoid (not shown) and then connects one of the engine shut-off leads 56 (FIGS. 1 and 3) from carbon-cleaning unit 10 to each of the connections so that the engine's fuel shut-off circuit is operating in series with carbon-cleaning unit 10. The operator then attaches a piece of reflective tape to a viewable surface on the harmonic balancer of the engine or main pulley and mounts a photoelectric tach probe 60 whereby the light beam therefrom is aimed at the reflective tape. However, is a good beam angle cannot be achieved or if the main drive pulley of the engine is inaccessible, a piece of reflective tape can be attached to any other more accessible engine pulley that is directly driven by the main drive pulley. A factor can then be entered into the tachometer's micro-processor 95. This factor can be derived by dividing the diameter of the engine's main drive pulley by the diameter of the desired reading pulley. For example: 6" Main divided by 2" Pulley=3.0 Factor.

Figure 3:
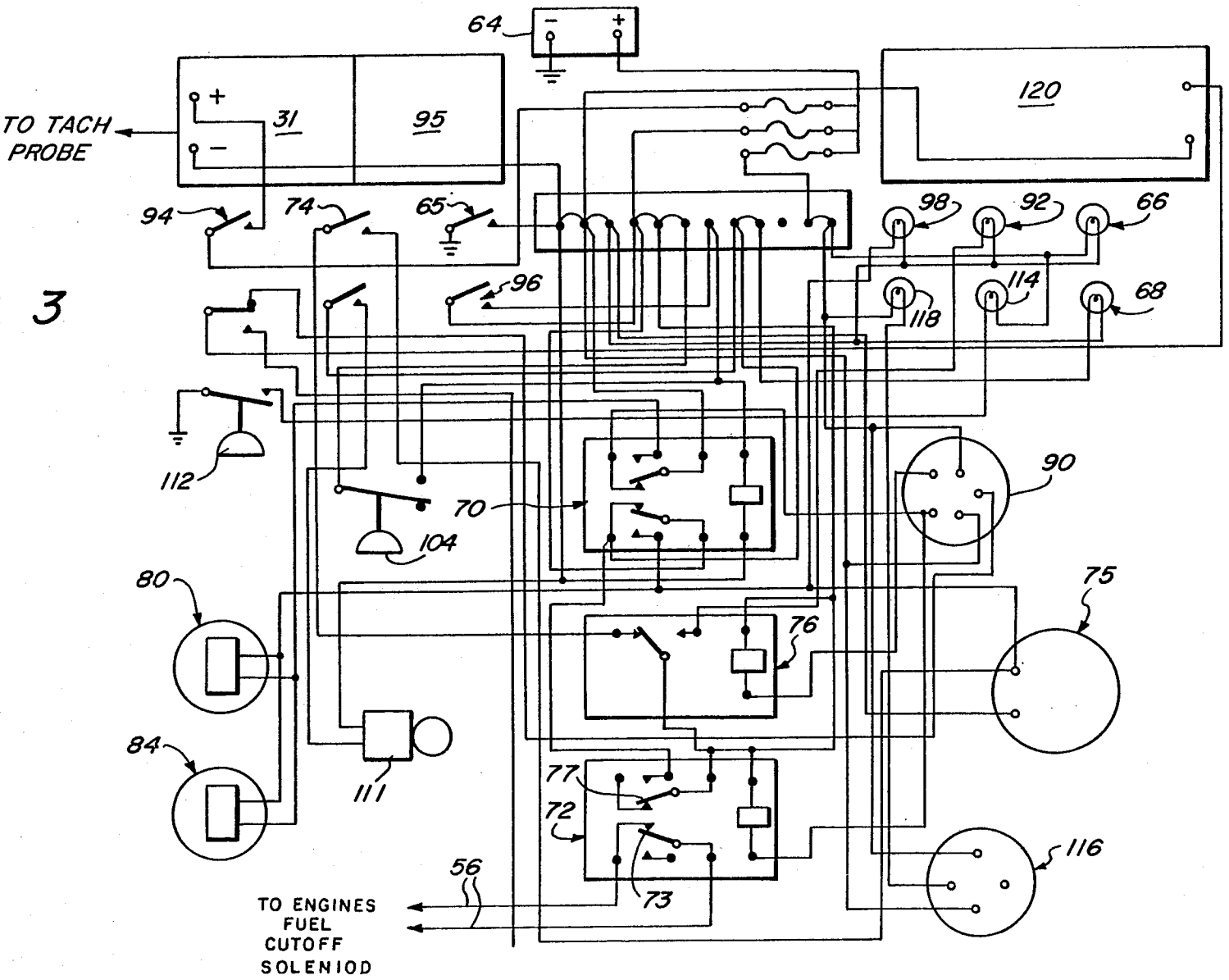
FIG. 3 is a wiring diagram of the carbon-cleaning apparatus which operably cooperates with the self-contained fuel-flow system.

Power supply cables 62 and 63 are connected to the proper power means such as a DC 12-volt battery 64 or the electrical system as shown in FIG. 3 is also adapted for use with a 115-volt AC power supply.

Mixture-supply tank 34 is filled with diesel fuel. An appropriate amount of cleaning chemical is added to tank 34 by means of filler neck 35 which includes a removable cap member 37, as shown in FIG. 1.

At this time, the "ON/OFF" switch indicated at 65 in the wiring diagram of FIG. 3 and by the numeral 1 in FIG. 1 is turned on to complete the ground circuit to the internal components of the apparatus. The "ON" and "COMPLETE" indicator lights 66 and 68 are activated and a negative voltage signal is sent through a 2P2T-type relay 70 which is in its open or rest position, as indicated in FIG. 3, and opens the contacts in relay 72 between the engine shutdown leads, thereby leaving the engine in an operable mode.

Figure 2:
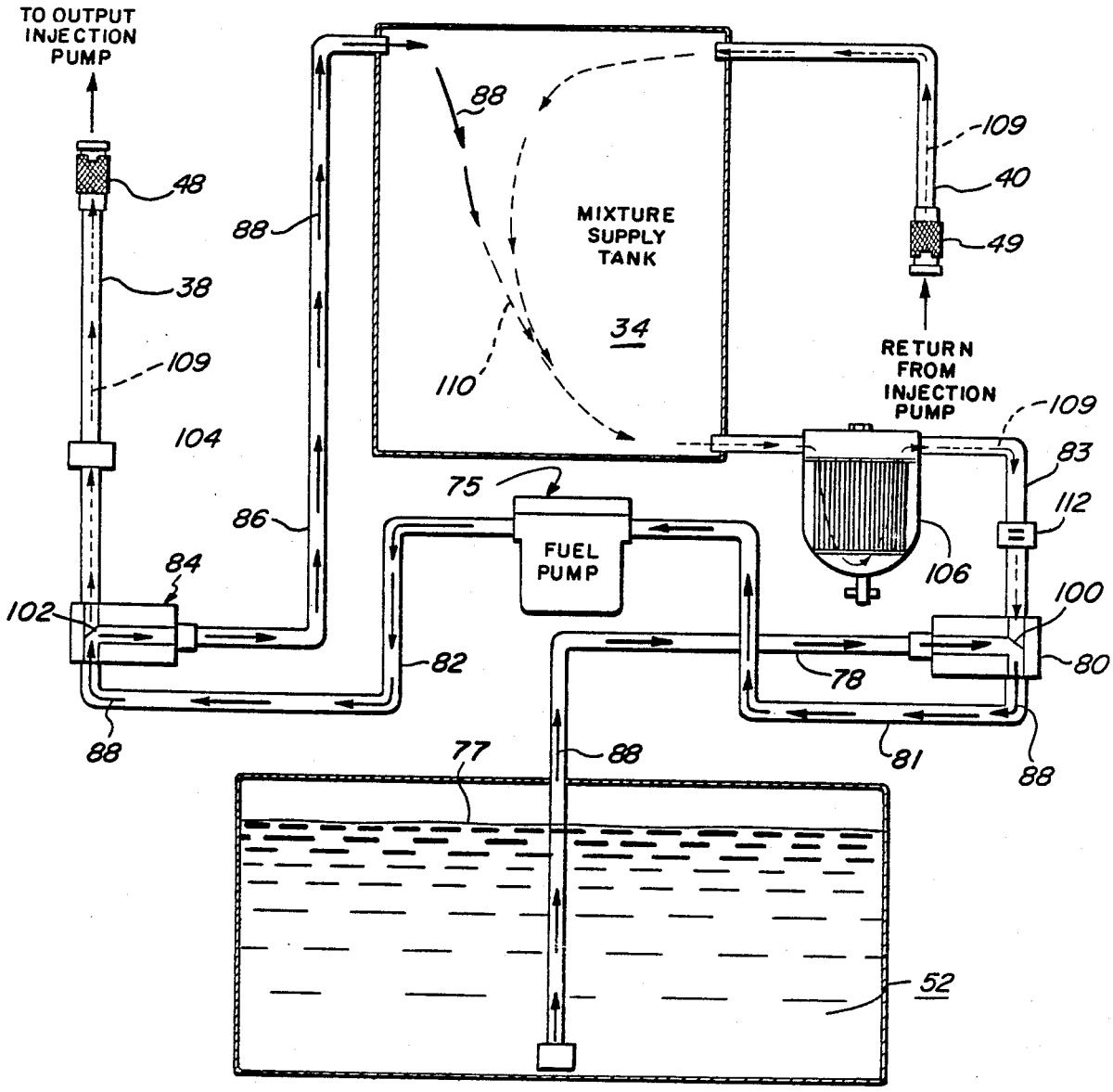
FIG. 2 is a schematic diagram of the self-contained fuel flow system which temporarily replaces a diesel engine's fuel system.

The operator then activates the fill switch 74 whereby positive voltage is applied to the fuel pump, generally indicated at 75, and through relay 76 which is in its rest position, (see FIGS. 2 and 3.) Fuel pump 75 then draws diesel fuel 77 from auxiliary diesel-supply tank 52 through three-way gate-valve solenoid 80 by way of discharge-flow line 78. Valve 100 of solenoid 80 is normally in an open position, as seen in FIG. 2. Hence, the unmixed diesel fuel is pumped through fuel lines 81 and 82 by means of pump 75 to output gate-valve solenoid valve means 84, that is also in a normally open position, and to the mixture-supply tank, as indicated by valve 102. Diesel fuel 77 flows from valve means 84 to mixture-supply tank 34 by inlet-flow line 86. Diesel fuel flows from auxiliary tank 52 to the mixture supply tank (indicated by arrows 88), thus defining a first fuel-flow sub-system.

When mixture-supply tank 34 is full, a negative voltage signal is sent from the fuel-level sending means 90 mounted in tank 34 to relay 76 which, in turn, energizes the relay and cuts power to fuel pump 75, thereby lighting the ready-indicator light 92. Fill switch 94 is then shut off.

Activated at this time is switch 94 which energizes the tachometer's micro-processor 94 and signal probe 60. The tachometer is now ready to operate. However, the tachometer can also be operated without performing the rest of the service.

Start switch 96 is now activated whereby positive voltage is applied to coil terminal 8 of relay 70, thereby energizing relay 70 and providing positive and negative voltage to the gate-valve solenoids 80 and 84, and to both fuel pump 75 and run-indicator light 98. Complete indicator light 68 and an alarm circuit are de-activated. Negative voltage is cut off to coil terminal 7 of relay 72 de-energizing the relay whereby contacts 73 are closed between the engine shutdown leads, thus allowing the engine to operate in a running mode.

The fuel and chemical mixture from mixture-supply tank 34 is then drawn through the now-open (normally closed) valve 100 of gate-valve solenoid 80 to fuel pump 75 by way of outlet fuel lines 83 and 81, and through filter 106 and a filter-blockage indicator means which are interposed in line 83. From fuel pump 75, the chemically mixed fuel is pumped through line 82 into gate valve 84.

The normally closed valve 102 is now in an open position to allow mixed fuel to be fed to the engine's fuel-injection pump by means of output line 38. As operating pressure is achieved (about 5 psi), pressure-cutout switch 104 is activated (closed) whereby positive voltage is applied to terminal 8 of relay 70, thus completing the circuit. The start switch is released and the unit continues operating. This operation is possible by establishing a secondary fuel-flow system between mixture tank 34 and the engine's fuel system.

The engine is now started with the chemical/fuel mixture being circulated through the engine's fuel system, the motor's rpm being adjusted to an appropriate speed. The unused chemical mixture along with contaminants are then returned to the mixture supply tank where the mixture is filtered by filter means 106 as the mixed fuel is re-introduced to the engine's fuel system. The flow of mixed fuel is indicated by arrows 109 illustrated in FIG. 2.

As the mixed fuel in tank 34 is used and nears empty, fuel-level control means 90 mounted within tank 34 sends a negative voltage signal to relay 72, and again opens contacts 73 and 77 between the two engine shutdown leads 56, thus shutting down the diesel engine. This also re-activates both the alarm circuit which includes a suitable alarm means 11, such as a buzzer, and the complete indicator light 68.

However, fuel pump 75 and both valve solenoids 80 and 84 are still activated and operating at this time. This is necessary as some diesel engines are not provided with a fuel cutoff solenoid. Under these conditions, only the alarm means 111 is activated to alert the operator to manually shut down the engine. It is important that the system continues to run so that air will not be inducted into the engine's fuel system, if the operator is not immediately available to shut the engine off.

If a pressure loss occurs during the cleaning cycle (i.e., hose failure or poor connection), the pressure-cut-off switch 104 in flow line 38 is de-activated and positive voltage is cut off to relay 70. When relay 70 is de-energized, alarm means 111 is activated. Relay 72 is re-energized and contacts 72 and 73 thereof are re-positioned to an open mode, thus shutting down the engine and activating the complete indicator light 68. Positive and negative voltage is also cut off to both the three-way gate-valve solenoids and to fuel pump 75, thus stopping all fuel mixture flow immediately and alerting the operator.

At any time during the operating cycle, should the system filter 106 become blocked or partially restricted, the vacuum switch 112 located between filter 106 and fuel pump 75 will sense the flow restriction and send a signal to activate the filter-indicator light 114.

When the auxiliary diesel-supply tank 52 nears empty, the level-sending means 116 located within tank 52 sends a signal to the level-indicator light 118 to alert the operator thereof that it is time to refill tank 52.

If water-contaminated diesel fuel should be introduced into either of the fuel tanks 34 or 52, level-sending means 90 and 116 will send an over full signal to the level-indicating meter 120, alerting the operator of water contaminants, whereupon both tanks are purged clean of all fuel and refilled.

The foregoing is a description of a preferred embodiment of the invention which is given here by way of example only. The invention is not to be taken as limited to any of the specific features as described, but comprehends all such variations thereof as come within the scope of the appended claims.

What I claim is:

1. A carbon-cleaning apparatus for diesel engines, wherein said apparatus defines an independent fuel system attachable to the diesel engine by way of the fuel-injection pump of the engine so as to temporarily replace the engine's closed fuel system, said apparatus comprising:

a fuel/chemical mixture tank having at least two fuel lines including an outlet line and a return line, said outlet and return lines being connected to the respective inlet and outlet ports of the engine's fuel-injection pump;

a fuel pump interposed in said outlet line whereby said fuel/chemical mixture is pumped to the engine's fuel-injection pump;

a filter means interposed in said outlet fuel line between said mixture tank and said fuel pump; and a circuit means for controlling the proper operation of said apparatus and the diesel engine being cleaned, said circuit being connected in series with the engine's fuel shut-off circuit.

2. A carbon-cleaning apparatus as recited in claim 1, wherein said apparatus includes:

an auxiliary fuel-supply tank having a discharge-flow line;

a first solenoid-valve means interposed in said outlet line of said mixture tank between said filter means and said fuel pump, and further connected to said auxiliary fuel-supply tank by means of said discharge-flow line; and a second solenoid-valve means interposed in said outlet line between said fuel pump and said mixture tank, and further connected to the fuel-injection pump of the engine by way of an output line, wherein each of said solenoid-valve means is operated by said circuit means.

3. A carbon-cleaning apparatus as recited in claim 2, wherein said circuit means includes means for controlling the sequential operation of said solenoid-valve means to control the flow of fuel therethrough, whereby in one sequence of operation the fuel from said auxiliary tank is supplied to said mixture tank and in a second sequence said fuel/chemical mixture from said mixture tank is supplied to the operating engine.

4. An apparatus as recited in claim 3, wherein said circuit means includes:

a mixture-tank level-indicator means positioned within said mixture tank whereby said means is activated by the level of fuel within said mixture tank;

said level-indicator means further defining means to control the starting and shutting down of the engine; and an auxiliary-tank level-indicator means positioned within said auxiliary tank whereby said means is activated by the level of fuel stored therein.

5. An apparatus as recited in claim 4, wherein said circuit means includes a vacuum-switch means positioned between said filter means and said fuel pump, said vacuum-switch means being activated by flow restriction within the closed fuel system.

6. An apparatus as recited in claim 5, wherein said circuit means includes a low-pressure cutoff switch means positioned in said output line between said second solenoid-valve means and the fuel system of the engine, said low-pressure cutoff switch means being activated when a selective pressure drop occurs in the closed fuel system.

7. An apparatus as recited in claim 6, wherein said circuit includes:

a first relay means;

a second relay means; and a third relay means.

8. An apparatus as recited in claim 7, wherein said apparatus includes a tachometer probe and wherein said circuit includes a tachometer micro-processor and a tachometer switch that, when activated, places said probe and micro-processor in an operating mode.

9. An apparatus as recited in claim 6, wherein said circuit means includes an alarm circuit.

10. An apparatus as recited in claim 8, wherein said circuit means includes an "ON/OFF" switch which in turn activates the circuitry to the internal components of the apparatus including an "ON" indicator light and a "COMPLETE" indicator light, and provides power to said first and second relay means.

11. An apparatus as recited in claim 10, wherein said circuit means includes:

a manually operated "FILL" switch which activates said fuel pump by means of said third relay means, whereby said fuel pump draws diesel fuel from said auxiliary tank through said first solenoid-valve means and pumps diesel fuel to and through said second solenoid-valve means into said fuel/chemical mixture tank, and wherein said level-sending means activates said third relay means which cuts power to said fuel pump and lights a "READY" indicator light, whereby the operator thereof releases said "FILL" switch; and a "START" switch connected to operate said first relay means, said first solenoid valve means and a "RUN" indicator light, whereby said "COMPLETE" indicator light and alarm circuit are deactivated and said second relay means is de-energized, thereby allowing the diesel engine to run.

12. An apparatus as recited in claim 8, wherein said tachometer micro-processor includes a display means.

13. An apparatus as recited in claim 11, including means to operate said apparatus on a 12-volt DC power supply.

14. An apparatus as recited in claim 11, including means to operate said apparatus on a 115-volt AC power supply.

15. A method of cleaning carbon deposits from a diesel engine by means of a carbon-cleaning apparatus having an independent fuel system without the need to dismantle said diesel engine, said method comprising the steps of:

disconnecting and plugging the inlet and return fuel lines of said engine;

attaching an output and return line of said independent fuel system to said engine in place of said engine's fuel lines;

storing a fuel/chemical mixture in a mixture tank, said output and return fuel lines of said independent fuel system being indirectly and directly connected to said engine;

storing fuel in an auxiliary supply tank wherein said auxiliary supply tank is connected to said mixture tank whereby fuel from said auxiliary tank may be transferred as needed to said mixture tank;

arranging said independent fuel system so as to be defined by a fuel/chemical flow sub-system and a fuel flow sub-system as required, wherein said fuel/chemical flow sub-system transfers the mixture fuel from said mixture tank to said engine, the excess mixture fuel being returned to said mixture tank while said engine is operating, and wherein said fuel flow sub-system transfers fuel from said auxiliary tank to said mixture tank.

16. A method as described in claim 15, including the step of filtering said fuel-chemical mixture being discharged from said mixture tank.

17. A method as described in claim 15, wherein a first and second solenoid valve means are operated to control fuel flow within said fuel/chemical flow sub-system and said fuel flow sub-system.

18. A method as described in claim 15, including the step of controlling the operation of said carbon-cleaning apparatus by means of an electronic circuit which includes means for indicating the level of the fuel/chemical within said mixture tank and level-indicating means for indicating the level of fuel within said auxiliary tank.

19. A method as described in claim 15, including a fuel pump positioned within said independent fuel system whereby fuel is transferred during the operation of said respective sub-systems.

* * * * *